US007988265B2

(12) United States Patent
Smith

(10) Patent No.: US 7,988,265 B2
(45) Date of Patent: Aug. 2, 2011

(54) AIR DETECTION IN INKJET PENS

(75) Inventor: Mark A. Smith, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 720 days.

(21) Appl. No.: 11/495,223

(22) Filed: Jul. 27, 2006

(65) Prior Publication Data

US 2008/0024565 A1 Jan. 31, 2008

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/7, 19, 86, 65, 92, 89, 85
See application file for complete search history.

(56) References Cited

U.S. PATENT DOCUMENTS

| | | | | |
|---|---|---|---|---|
| 4,183,029 | A | 1/1980 | Isayama et al. | |
| 4,368,478 | A * | 1/1983 | Koto | 347/86 |
| 4,498,088 | A | 2/1985 | Kanayama | |
| 4,558,333 | A * | 12/1985 | Sugitani et al. | 347/65 |
| 5,072,235 | A | 12/1991 | Slowik et al. | |
| 5,162,817 | A * | 11/1992 | Tajika et al. | 347/7 |
| 5,289,211 | A * | 2/1994 | Morandotti et al. | 347/7 |
| 5,500,657 | A | 3/1996 | Yauchi et al. | |
| 5,572,241 | A * | 11/1996 | Kanayama et al. | 347/7 |
| 5,710,579 | A | 1/1998 | Hahs et al. | |
| 6,007,193 | A * | 12/1999 | Kashimura et al. | 347/92 |
| 6,257,694 | B1 | 7/2001 | Tokumaru et al. | |
| 6,264,302 | B1 | 7/2001 | Imanaka et al. | |
| 6,322,182 | B1 * | 11/2001 | Lin et al. | 347/7 |
| 6,398,329 | B1 * | 6/2002 | Boyd et al. | 347/7 |
| 6,428,156 | B1 * | 8/2002 | Waller et al. | 347/89 |
| 6,554,382 | B1 | 4/2003 | Sleger | |
| 6,652,053 | B2 * | 11/2003 | Imanaka et al. | 347/7 |
| 6,871,925 | B2 | 3/2005 | Yamamoto et al. | |
| 6,874,861 | B2 | 4/2005 | Farr et al. | |
| 6,929,343 | B2 | 8/2005 | Farr et al. | |
| 7,311,374 | B2 * | 12/2007 | Oomura | 347/19 |
| 2002/0101468 | A1 | 8/2002 | Roman et al. | |
| 2004/0223021 | A1 * | 11/2004 | Farr et al. | 347/19 |
| 2005/0001863 | A1 * | 1/2005 | Farr et al. | 347/7 |
| 2005/0007427 | A1 * | 1/2005 | Bellinger et al. | 347/86 |
| 2005/0012795 | A1 | 1/2005 | Katayama | |
| 2005/0134628 | A1 | 6/2005 | Roman et al. | |
| 2006/0164473 | A1 * | 7/2006 | Davis et al. | 347/85 |

FOREIGN PATENT DOCUMENTS

JP 2000296614 A * 10/2000

* cited by examiner

*Primary Examiner* — Stephen Meier
*Assistant Examiner* — Carlos A Martinez

(57) ABSTRACT

An inkjet pen includes a standpipe plenum, a printhead in fluid communication with the standpipe plenum, and a detector for detecting the amount of air in the standpipe plenum. A printing system including such an inkjet pen further includes structure for removing air from the standpipe plenum. Air is removed from the standpipe plenum when the amount of air detected in the standpipe plenum reaches a predetermined level.

16 Claims, 3 Drawing Sheets

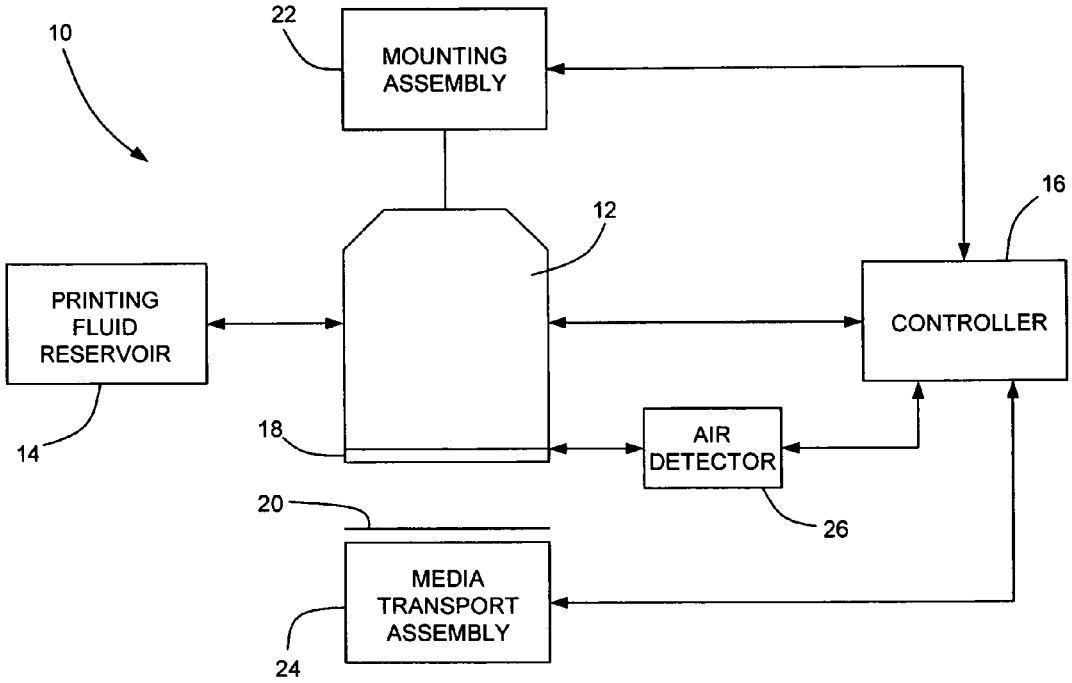
FIG. 1
FIG. 2
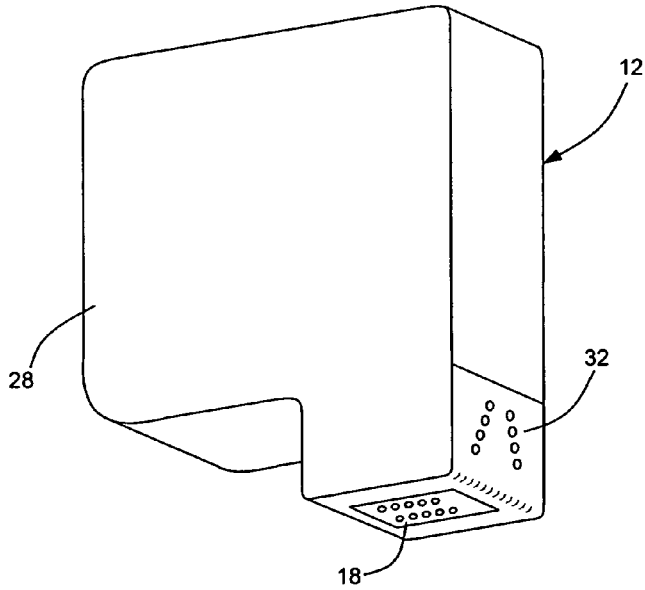

AIR DETECTION IN INKJET PENS

BACKGROUND OF THE INVENTION

Inkjet printing technology is used in many commercial products such as computer printers, graphics plotters, copiers, and facsimile machines. One type of inkjet printing, known as "drop on demand," employs one or more inkjet pens that eject drops of ink onto a print medium such as a sheet of paper. Printing fluids other than ink, such as preconditioners and fixers, can also be utilized. The pen or pens are typically mounted to a movable carriage that traverses back-and-forth across the print medium. As the pens are moved repeatedly across the print medium, they are activated under command of a controller to eject drops of printing fluid at appropriate times. With proper selection and timing of the drops, the desired pattern is obtained on the print medium.

An inkjet pen generally includes at least one fluid ejection device, commonly referred to as a printhead, which has a plurality of orifices or nozzles through which the drops of printing fluid are ejected. Adjacent to each nozzle is a firing chamber that contains the printing fluid to be ejected through the nozzle. Ejection of a fluid drop through a nozzle may be accomplished using any suitable ejection mechanism, such as thermal bubble or piezoelectric pressure wave to name a few. Printing fluid is delivered to the firing chambers from a printing fluid reservoir to refill the chamber after each ejection. An inkjet pen typically includes a standpipe that delivers printing fluid from the printing fluid reservoir to the printhead. A screen filter is disposed at the entrance of the standpipe to prevent particulate contaminants or free air in the printing fluid from reaching and clogging the printhead.

During operation, relatively cool printing fluid is drawn into the standpipe and is warmed as it flows toward the printhead. The printhead generates heat as its fluid ejectors are activated or fired to eject droplets of printing fluid through the nozzles. For a primarily water-based printing fluid, the solubility of air decreases as the printing fluid is heated. As a result, air is driven out of the printing fluid and accumulates in the standpipe. Often, the standpipe includes a chamber, referred to as the standpipe plenum, that temporarily warehouses the air. Because of the extremely small pore size of the screen filter, air does not readily pass through the filter into the printing reservoir and becomes trapped in the standpipe plenum. Over time, the standpipe plenum may be filled with sufficient air to restrict the proper flow of printing fluid. Printing under such conditions results in print defects. Moreover, the amount of air trapped in the standpipe plenum can eventually reach the point of causing complete printing fluid starvation or depriming of the printhead so as to render the inkjet pen useless.

In order to avoid depriming of the printhead, it is common to employ preemptive priming by purging the air from the standpipe plenum. Currently, such preemptive priming operations are performed based on estimates of the amount of air present in the standpipe plenum. However, predicting when the standpipe plenum will actually need to be purged of air is difficult because many factors influence the rate of air accumulation in the plenum. Typically, testing is done to characterize the time or amount of printing fluid expended between deprime events. These data are very noisy and as a consequence conservative trigger points are selected to protect the user from deprimes. This means that the majority of priming operations occur more frequently than necessary, resulting in wasted printing fluid and user delays waiting for the unnecessary priming operation to complete.

DESCRIPTION OF THE DRAWINGS

FIG. 1 is a block diagram of one embodiment of an inkjet printing system.

FIG. 2 is a perspective view of one embodiment of an inkjet pen.

DETAILED DESCRIPTION OF THE INVENTION

Figure 3:
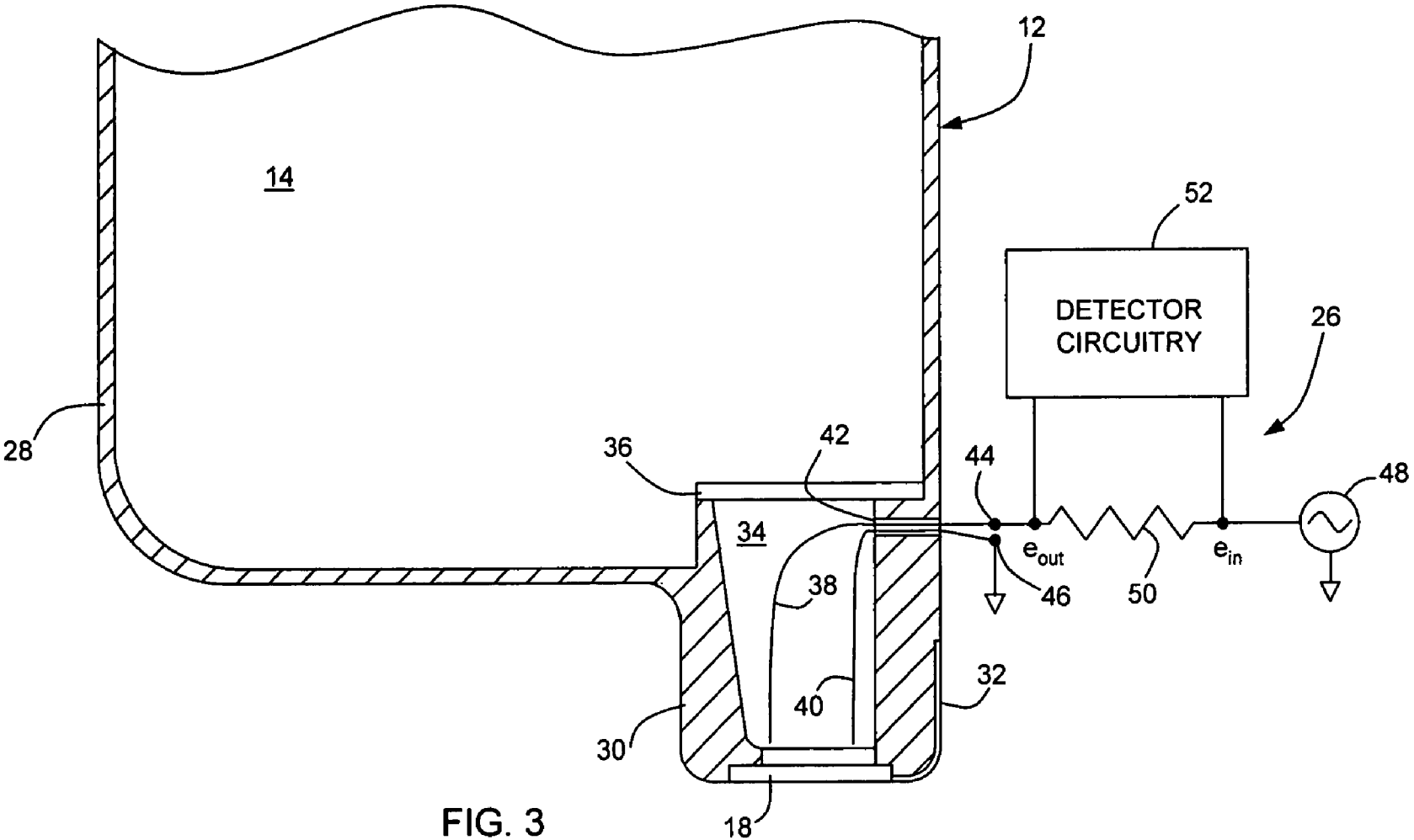
FIG. 3 is a partial, cross-sectional view of the inkjet pen of FIG. 2.

Referring to the drawings wherein identical reference numerals denote the same elements throughout the various views, FIG. 1 shows one embodiment of an inkjet printing system 10. As used herein, the term "printing system" is intended to encompass any system or device that prints on a print medium (i.e., produces hard copy). Such devices include, but are not limited to, computer printers, graphics plotters, copiers, facsimile machines and the like. Furthermore, the term "inkjet printing system" refers to any system or device that uses inkjet technology for producing hard copy.

The printing system 10 includes an inkjet pen 12, a printing fluid reservoir 14, and an electronic controller 16, which can be any controller suitable for use in printing systems, many of which are known in the art. The inkjet pen 12 includes a printhead 18 that is fluidly connected to the printing fluid reservoir 14 so as to receive printing fluid therefrom. As used herein, the term "printing fluid" refers to any fluid used in a printing process, including but not limited to inks, preconditioners, fixers, etc. The printhead 18 includes a plurality of fluid ejection mechanisms (not shown in FIG. 1) for ejecting drops of printing fluid onto a print medium 20, such as paper, card stock, transparencies or the like, positioned adjacent to the printhead 18. The fluid ejection mechanisms may be configured to eject printing fluid in any suitable manner. Examples include, but are not limited to, thermal and piezoelectric fluid ejection mechanisms.

The printing fluid reservoir 14 provides a supply of printing fluid and can have either an "off-axis" configuration or an "on-axis" configuration. With an off-axis configuration, a relatively small reservoir located onboard the inkjet pen 12 is fluidly coupled to one or more off-board fluid reservoirs. The onboard fluid reservoir is in fluid communication with the printhead 18. In an on-axis configuration, the printing fluid reservoir is wholly contained onboard the inkjet pen 12.

The inkjet pen 12 can be mounted to a mounting assembly 22 configured to move the pen 12 and the printhead 18 relative to the print medium 20. In one embodiment, the mounting assembly 22 is a scanning carriage that traverses the printhead 18 back-and-forth across the print medium 20. The printing system 10 may also include a media transport assembly 24 that is positioned relative to the mounting assembly 22 so as to define a print zone adjacent to the printhead 18. The media transport assembly 24 moves the print medium 20 through the print zone so that drops of printing fluid ejected by the printhead 18 are directed onto the print medium 20. Typically, the mounting assembly 22 moves printhead 18 in a direction generally orthogonal to the direction in which the media transport assembly 24 moves the print medium 20, thus enabling printing over a wide area of the print medium 20.

The controller 16 receives data from a host system (not shown) and includes memory for temporarily storing the data. The data defines a print job for the inkjet printing system 10 and includes one or more print job commands and/or command parameters. In response to the data, the controller 16 provides control of the printhead 18, including timing control for ejection of printing fluid. The controller 16 also controls the mounting assembly 22 and the media transport assembly 24 to provide the desired relative positioning of the printhead 18 and the print medium 20.

The inkjet pen 12 defines a standpipe (not shown in FIG. 1) that delivers printing fluid from the printing fluid reservoir 14 to the printhead 18, and a standpipe plenum (also not shown in FIG. 1). During operation, air can accumulate in the standpipe plenum. The printing system 10 includes an air detector 26 for detecting the amount of air in the standpipe plenum. In response to the air detector 26 detecting that the amount of air in the standpipe plenum has reached a predetermined level, the controller 16 can initiate a priming operation to remove the air from the standpipe plenum.

Referring to FIGS. 2 and 3, one possible embodiment of the inkjet pen 12 is shown in more detail. The pen 12 includes a body 28 that defines an internal chamber that contains printing fluid. For the sake of convenience, this chamber is referred to hereinafter as the printing fluid reservoir 14. However, this does not mean that the printing fluid reservoir 14 is necessarily confined to the inkjet pen 12. The printing fluid reservoir 14 of FIG. 3 can be fluidly coupled to one or more off-board fluid reservoirs to provide an off-axis configuration, or it can be wholly contained onboard the inkjet pen 12 to provide on-axis configuration. Although not shown in FIG. 3, the printing fluid reservoir 14 will typically contain a backpressure control device such as foam or a spring bag.

Located in the lower right corner of the inkjet pen body 28 (as oriented in FIGS. 2 and 3) is a snout or nosepiece structure 30 that protrudes outwardly. The printhead 18 is mounted at the bottom of the nosepiece structure 30, and appropriate electrical connectors 32 (such as a "flex circuit") are provided on the nosepiece structure 30 for transmitting signals to and from the printhead 18. The nosepiece structure 30 defines a standpipe, which delivers printing fluid from the reservoir 14 to the printhead 18 at the bottom of the nosepiece structure 30. As used herein, the term "standpipe" refers to any chamber, channel, conduit or other passage, or a combination of such passages, that establishes fluid communication between the printing fluid reservoir 14 and the printhead 18. The standpipe includes a standpipe plenum 34. As used herein, a "standpipe plenum" refers to a portion of the standpipe in which air can accumulate. (In the embodiment depicted in FIG. 3, the standpipe plenum 34 is coincident with the entire standpipe.) A filter 36 is located at the top or entrance of the standpipe plenum 34 to prevent particulate contaminants or free air in the printing fluid from reaching and clogging the printhead 18. The portion of the inkjet pen 12 located below the filter 36 is generally referred to as the standpipe region.

The air detector 26 can be any suitable detector. Examples include, but are not limited to, resistance-based detectors, capacitance-based detectors, pressure-based detectors and optical detectors. In the illustrated embodiment, the air detector 26 is a resistance-based detector comprising first and second electrodes 38 and 40 disposed within the standpipe plenum 34. The first and second electrodes 38 and 40 are positioned inside the standpipe plenum 34 so that their distal tips are spaced apart relative to one another and are in close proximity to the printhead 18 at the bottom of the standpipe plenum 34. With this arrangement, the first and second electrodes 38 and 40 will be in direct contact with printing fluid in the standpipe plenum 34. In the depicted embodiment, the first and second electrodes 38 and 40 extend through an opening 42 formed in the wall of the pen body 28 near the top of the standpipe plenum 34 to a pair of external contacts, which are illustrated schematically in FIG. 3 as first contact 44 and second contact 46. The opening 42 is sealed to prevent leakage of printing fluid. The electrical contacts 44 and 46 may be configured to automatically form a connection with complementary contacts (not shown) in the printing system 10 when the inkjet pen 12 is mounted in place. Although not shown as such in FIG. 3, the electrical contacts 44 and 46 may be incorporated into the flex circuit 32.

The first and second electrodes 38 and 40 may have any suitable shape and size. For example, the first and second electrodes 38 and 40 may have thin, wire-like configurations that fit well in a relatively small standpipe plenum 34. Furthermore, the first and second electrodes 38 and 40 may be made of any suitable electrically conductive material. Examples of suitable materials include, but are not limited to, metals such as stainless steel, platinum, gold and palladium. Other possible materials include electrically conductive carbon materials such as activated carbon, carbon black, carbon fiber cloth, graphite, graphite powder, graphite cloth, glassy carbon, carbon aerogel, and cellulose-derived foamed carbon. To increase the conductivity of a carbon-based electrode, the carbon may be modified by oxidation. Examples of suitable techniques to oxidize the carbon include, but are not limited to, liquid-phase oxidations, gas-phase oxidations, plasma treatments, and heat treatments in inert environments. In some embodiments, the first and second electrodes 38 and 40 may be coated with an electrically conductive coating. For example, the first and second electrodes 38 and 40 may be coated with a material having a high surface area-to-volume ratio to increase the effective surface area of the electrode. The use of such a coating may allow smaller electrodes to be used without any sacrifice in measurement sensitivity. The use of a coating also may offer the further advantage of protecting the electrode material from corrosion by the printing fluid. Examples of suitable electrically conductive coatings include, but are not limited to, Teflon-based coatings (which may be modified with carbon), polypyrroles, polyanilines, polythiophenes, conjugated bithiazoles and bis-(thienyl)bithiazoles. Furthermore, the coating may be selectively crosslinked to reduce the level and type of adsorbed printing fluid components.

The air detector 26 also includes a power supply 48 configured to apply an alternating signal to the first electrode 38 (or, equivalently, across the first and second electrodes). A resistor 50 is disposed between the power supply 48 and the first electrode 38, in series with the first electrode 38, the second electrode 40 and the printing fluid in the standpipe plenum 34. The air detector 26 further includes detector circuitry 52 configured to determine resistance of the printing fluid. The detector circuitry 52 compares the supply signal measured at $e_{in}$ and a detected signal measured at $e_{out}$ to determine the voltage drop across the printing fluid in the standpipe plenum 34. As shown in FIG. 3, $e_{in}$ is measured at the power supply side of the resistor 50, and $e_{out}$ is measured at the printing fluid side of the resistor 50. The detector circuitry 52 also determines the amount of current flowing through the printing fluid. Then, applying Ohms Law, the detector circuitry 52 calculates the resistance of the printing fluid by dividing the measured voltage drop by the measured current.

Because the printing fluid resistance is a function of the amount of printing fluid in the standpipe plenum 34, the fluid resistance rises as the level of printing fluid in the standpipe plenum 34 drops. Thus, as air accumulates in the standpipe plenum 34, the printing fluid level drops and the detected resistance rises. Accordingly, because the total volume of the standpipe plenum 34 is a known, constant quantity, a correlation can be drawn between the printing fluid resistance and the amount of air in the standpipe plenum 34. For example, the detector circuitry 52 may include a processor and a memory that stores instructions executable by the processor to perform the comparison of the supply signal and the detected signal and calculate the resistance of the printing fluid. The memory also stores a look-up table of resistance values and the associated amounts of air in the standpipe plenum 34 for each resistance value. The processor compares the calculated resistance value to known resistance values arranged in the look-up table to determine the amount of air in the standpipe plenum 34. Alternatively, the detector circuitry memory could include a simple threshold trigger, as opposed to a look-up table, that identifies the resistance value corresponding a predetermined threshold amount of air in the standpipe plenum 34. It will be appreciated that the detector circuitry 52 can be incorporated into the controller 16 or comprise separate circuitry.

With this arrangement, a limit can be established for the amount of air allowed to accumulate in the standpipe plenum 34 before depriming becomes a threat to system operation. When the amount of air in the standpipe plenum 34 approaches that predetermined limit (as detected by the detector circuitry 52), the controller 16 is triggered to initiate a priming operation to remove the air from the standpipe plenum 34. Generally, when the predetermined limit is approached or detected during an ongoing print job, the air can be purged at the next convenient opportunity, such as at the end of the current print job. Alternatively, for larger print jobs and/or where deprime is imminent, the purge could be carried out after printing of the current page is completed.

The air detector 26 is not limited to a resistance-based detector; the same detector structure of FIG. 3 could alternatively be used to measure the capacitance or total impedance of the printing fluid in the standpipe 34. For example, when the first and second electrodes 38 and 40 are placed in an ionic printing fluid and charged with opposite polarities, a layer of negative ions forms on the positively charged electrode and a layer of positive ions forms on the negatively charged electrode. Furthermore, additional layers of positive and negative ions form on the innermost ion layers, forming alternating layers of oppositely charged ions extending outwardly into the printing fluid from each electrode 38 and 40. This charge structure is referred to as an electrical double layer (EDL), due to the double charge layer represented by the charges in the electrode and the charges in the first ion layer on the electrode surface. The EDL at each electrode acts effectively a capacitor, wherein the layer of ions acts as one plate and the electrode acts as the other plate. Due to the atomic-scale proximity of the ions to the electrode in the EDL, and to the fact that capacitance varies inversely with the distance of charge separation in a capacitor, extremely large capacitances per unit electrode surface area are generated in the EDLs associated with the first and second electrodes 38 and 40.

As is well known in the electrical arts, a capacitor may cause a phase shift in an alternating signal, in that the current through the capacitor lags the voltage across the capacitor. This effect is observed with EDL capacitance. Thus, the phase shift of the supply signal measured at $e_{in}$ relative to the detected signal measured at $e_{out}$ may be used to determine the capacitance of the first and second electrodes 38 and 40 in the printing fluid. Because the total capacitance of the first and second electrodes 38 and 40 is a function of the amount of charge stored on each electrode, the capacitance of the electrodes drops as the fluid level (and thus the size of each EDL) drops. Thus, as air accumulates in the standpipe plenum 34, the printing fluid level drops and the detected capacitance also drops. This drop in capacitance is observed as a decrease in the phase shift between the supply signal measured $e_{in}$ and the detected signal measured at $e_{out}$. This enables a look-up table of phase shifts and associated printing fluid levels to be constructed and stored in the memory of the detector circuitry 52. The detector circuitry processor may be programmed to match a measured phase shift value to a closest phase shift value in the look-up table in the memory, and thereby determine the amount of air in the standpipe plenum 34 corresponding to the measured phase shift value.

During a priming operation, air is purged from the standpipe plenum 34 by any suitable means. For example, in an open-loop priming operation, a priming cap (not shown) is sealed over the printhead 18, and a vacuum is created in the cap. The vacuum draws printing fluid and air in the standpipe plenum 34 through the nozzles of the printhead 18, and the withdrawn printing fluid and air are replaced with air-free printing fluid from the printing fluid reservoir 14. The printing fluid extracted with the purged air is generally discarded. In a closed-loop priming operation, the air and printing fluid are removed from the standpipe plenum via a separate outlet, and the extracted printing fluid can be re-circulated to the printing fluid reservoir 14.

Figure 4:
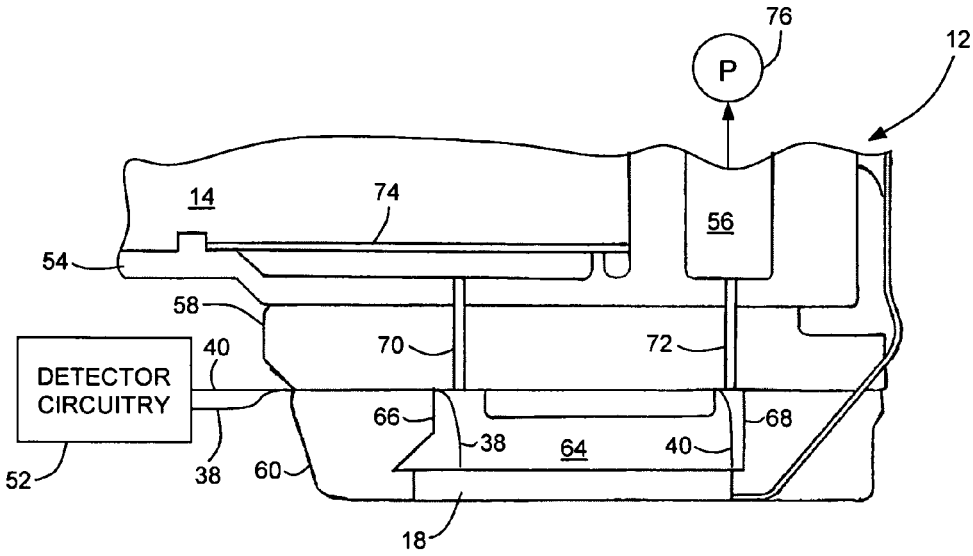
FIG. 4 is a partial, cross-sectional view of another embodiment of an inkjet pen.

Referring to FIG. 4, another possible embodiment of the inkjet pen 12 is shown. In this embodiment, the pen 12 includes a housing 54 that defines an internal chamber that contains printing fluid. As with the embodiment of FIG. 3, this chamber is also referred to hereinafter as the printing fluid reservoir 14 for the sake of convenience. However, this does not mean that the printing fluid reservoir 14 is necessarily confined to the inkjet pen 12. The printing fluid reservoir 14 of FIG. 4 can be fluidly coupled to one or more off-board fluid reservoirs to provide an off-axis configuration, or it can be wholly contained onboard the inkjet pen 12 to provide on-axis configuration. The housing 54 also defines a re-circulation chamber 56.

A base 58 is attached to the bottom of the housing 54 (as oriented in FIG. 4), and a die carrier body 60 is attached to the base 58. The printhead 18 is mounted at the bottom of the die carrier body 60, and appropriate electrical connectors 62 (such as a "flex circuit") are provided for transmitting signals to and from the printhead 18. The die carrier body 60 defines a standpipe plenum 64 having an inlet 66 and an outlet 68. The plenum inlet 66 is in fluid communication with the printing fluid reservoir 14 via a series of channels formed through the base 58 and the bottom wall of the housing 54, which are represented schematically as first passage 70. The plenum outlet 68 is in fluid communication with the re-circulation chamber 56 via a series of channels formed through the base 58 and the bottom wall of the housing 54, which are represented schematically as second passage 72. The standpipe plenum 64 delivers printing fluid from the reservoir 14 to the printhead 18. A filter 74 is located at the bottom of the printing fluid reservoir 14, over the first passage 70, to prevent particulate contaminants or free air in the printing fluid from reaching and clogging the printhead 18. The portion of the inkjet pen 12 located below the filter 74 is generally referred to as the standpipe region.

As with the previously described embodiment, the air detector 26 includes first and second electrodes 38 and 40 disposed within the standpipe plenum 64. The first electrode 38 extends through the plenum inlet 66, and the second electrode 40 extends through the plenum outlet 68. The electrodes 38 and 40 are thus positioned inside the standpipe plenum 64 so that their distal tips are spaced apart relative to one another and are in close proximity to the printhead 18 at the bottom of the standpipe plenum 64. In the depicted embodiment, the first and second electrodes 38 and 40 both extend out of the inkjet pen 12 between the base 58 and the die carrier 60. This interface is typically sealed with a gasket (not shown in FIG. 4). The first and second electrodes 38 and 40 connect to detector circuitry 52, which can be the same as that described above in connection with FIG. 3 and is therefore not described in detail here.

During a priming operation, air and printing fluid are drawn out of the standpipe plenum 64 through the outlet 68 and into the re-circulation chamber 56 by any suitable means, such as a peristaltic pump 76. Printing fluid in the re-circulation chamber 56 can be returned to the reservoir 14.

Figure 5:
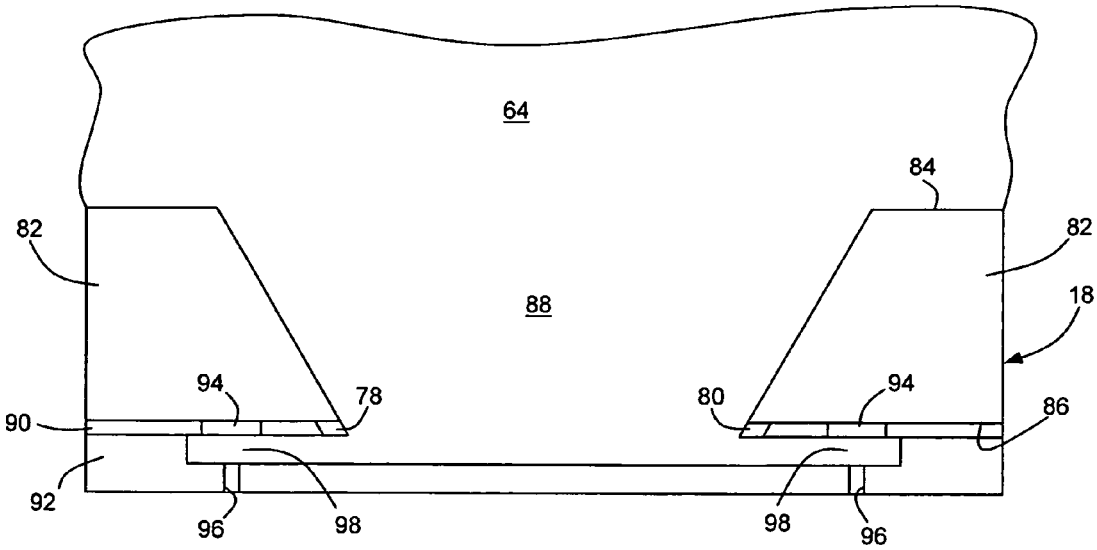
FIG. 5 is a cross-sectional view of an inkjet printhead having electrodes formed therein.

Turning now to FIG. 5, an alternative to the wire electrodes of the FIGS. 3 and 4 embodiments is described. In this case, the air detector includes first and second electrodes 78 and 80 that are embedded into the printhead 18. The printhead 18 includes a substrate or die 82 having first and second opposing surfaces 84 and 86 and at least one fluid feed hole 88 formed therein. The first substrate surface 84 faces the standpipe plenum 64 so that the fluid feed hole 88 is in fluid communication with the printing fluid in the standpipe plenum 64. A thin film stack 90 is disposed on the second substrate surface 86, and an orifice plate 92 is disposed on the thin film stack 90.

As is known in the art, the thin film stack 90 can generally include an oxide layer, an electrically conductive layer, a resistive layer, a passivation layer, and a cavitation layer or sub-combinations thereof. The thin film stack 90 includes fluid ejectors 94, which are resistors in the illustrated embodiment. However, it should be noted that thermally active resistors are described here by way of example only; the present invention could include other types of fluid ejectors such as piezoelectric actuators. Furthermore, the thin film stack 90 includes the first and second electrodes 78 and 80, which are located on opposite edges of the fluid feed hole 88 so as to be in contact with the printing fluid. The first and second electrodes 78 and 80 are electrically connected to the detector circuitry via the flex circuit 62 (not shown in FIG. 5).

The orifice plate 92 defines a nozzle 96 and a firing chamber 98 associated with each fluid ejector 94, which function to eject drops of printing fluid through the corresponding nozzle 96. The firing chambers 98 are in fluid communication with the fluid feed hole 88 and are thus replenished with printing fluid after a drop is ejected.

While specific embodiments of the present invention have been described, it should be noted that various modifications thereto could be made without departing from the spirit and scope of the invention as defined in the appended claims.

What is claimed is:

1. A printing system comprising:

a printing fluid reservoir;

an inkjet pen having a standpipe plenum in fluid communication with said printing fluid reservoir and a printhead in fluid communication with said standpipe plenum;

an air detector having first and second electrodes disposed in said standpipe plenum; and means for removing air from said standpipe plenum, wherein said first and second electrodes are provided adjacent first and second ends, respectively, of said printhead, wherein said standpipe plenum includes an inlet and an outlet, wherein said first and second electrodes extend through said inlet and said outlet, respectively, wherein said printing fluid reservoir provides printing fluid to said standpipe plenum through said inlet in a first direction, wherein said printhead is in fluid communication with said standpipe plenum between said inlet and said outlet, wherein said printhead is adapted to eject drops of said printing fluid in said first direction, and wherein said means for removing air from said standpipe plenum removes air through said outlet to a re-circulation chamber in second direction opposite said first direction when the amount of air reaches a predetermined level.

2. The printing system of claim 1 wherein said air detector includes a power supply connected across said first and second electrodes.

3. The printing system of claim 2 wherein said air detector further includes circuitry for determining a resistance between said first and second electrodes and determining an amount of air in said standpipe plenum based on said resistance.

4. The printing system of claim 2 wherein said air detector further includes circuitry for determining a capacitance of said first and second electrodes and determining an amount of air in said standpipe plenum based on said capacitance.

5. The printing system of claim 1 wherein said first and second electrodes have a wire-like configuration.

6. The printing system of claim 1 further comprising a filter disposed between said printing fluid reservoir and said standpipe plenum.

7. The printing system of claim 1 wherein said means for removing air from said standpipe plenum removes air through said outlet away from said printhead.

8. The printing system of claim 1 wherein said inlet of said standpipe plenum is provided adjacent said first end of said printhead and said outlet of said standpipe plenum is provided adjacent said second end of said printhead.

9. The printing system of claim 1 wherein said printhead includes fluid ejectors adapted to eject drops of printing fluid through corresponding nozzles in said first direction substantially perpendicular to said fluid ejectors.

10. The printing system of claim 1 wherein said printhead includes an orifice plate through which drops of said printing fluid are ejected, and wherein said first and second directions are substantially perpendicular to a front face of said orifice plate.

11. A method for priming an inkjet pen having a standpipe plenum and a printhead in fluid communication with said standpipe plenum, said method comprising:

detecting the amount of air in said standpipe plenum; and purging air from said standpipe plenum when the amount of air detected reaches a predetermined level, wherein detecting the amount of air in said standpipe plenum comprises extending a first electrode through an inlet formed in said standpipe plenum and extending a second electrode through an outlet formed in said standpipe plenum, wherein said first and second electrodes are provided adjacent first and second ends, respectively, of said printhead, and wherein printing fluid is provided to said standpipe plenum through said inlet in a first direction, wherein said standpipe plenum supplies printing fluid to said printhead between said inlet and said outlet, wherein purging air from said standpipe plenum comprises drawing air through said outlet and into a re-circulation chamber in a second direction opposite said first direction, and wherein said first and second directions are substantially perpendicular to an orifice plate surface of said printhead from which drops of said printing fluid are ejected.

12. The method of claim 11 wherein detecting the amount of air in said standpipe plenum comprises determining a resistance of printing fluid in said standpipe plenum and determining the amount of air in said standpipe plenum based on said resistance.

13. The method of claim 11 wherein detecting the amount of air in said standpipe plenum comprises determining a capacitance caused by printing fluid in said standpipe plenum and determining the amount of air in said standpipe plenum based on said capacitance.

14. The method of claim 11 wherein when the amount of air detected in said standpipe plenum reaches said predetermined level during an ongoing print job, air is purged from said standpipe plenum after completion of said print job.

15. The method of claim 11 wherein purging air from said standpipe plenum comprises drawing air through said outlet away from said printhead.

16. The method of claim 11 wherein said printhead includes fluid ejectors adapted to eject drops of printing fluid through corresponding nozzles in said first direction substantially perpendicular to said fluid ejectors.

* * * * *

UNITED STATES PATENT AND TRADEMARK OFFICE

CERTIFICATE OF CORRECTION

PATENT NO. : 7,988,265 B2
APPLICATION NO. : 11/495223
DATED : August 2, 2011
INVENTOR(S) : Mark A. Smith It is certified that error appears in the above-identified patent and that said Letters Patent is hereby corrected as shown below:

In column 8, line 9, in Claim 1, delete "second" and insert -- a second --, therefor.

Signed and Sealed this
Twenty-seventh Day of March, 2012

David J. Kappos

David J. Kappos
*Director of the United States Patent and Trademark Office*